US007185979B2

(12) United States Patent
Mizutani et al.

(10) Patent No.: US 7,185,979 B2
(45) Date of Patent: Mar. 6, 2007

(54) TRANSFERRING PRESSURE ROLL, TRANSFERRING UNIT AND INK JET RECORDING APPARATUS

(75) Inventors: Hajime Mizutani, Nagano (JP); Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 10/675,866

(22) Filed: Sep. 30, 2003

(65) Prior Publication Data

US 2005/0099479 A1 May 12, 2005

(30) Foreign Application Priority Data

Sep. 30, 2002 (JP) ..... P2002-286120
Mar. 14, 2003 (JP) ..... P2003-070542
Sep. 26, 2003 (JP) ..... P2003-335547

(51) Int. Cl.
*B41J 2/01* (2006.01)

(52) U.S. Cl. ..... 347/101; 347/105

(58) Field of Classification Search ..... 347/101, 347/103, 88, 105, 102, 104; 428/32.1
See application file for complete search history.

(56) References Cited

U.S. PATENT DOCUMENTS 6,176,286 B1 1/2001 Kitagawa et al.
6,377,777 B1 * 4/2002 Kishino et al. ..... 399/329
6,471,810 B2 10/2002 Sawano
6,528,146 B2 * 3/2003 Okuda et al. ..... 347/101
6,540,860 B1 * 4/2003 Suzuki ..... 156/230
6,654,040 B2 * 11/2003 Kasperchik et al. ..... 347/213
6,802,355 B2 * 10/2004 Kline et al. ..... 156/584
2002/0005886 A1 1/2002 Iwata
2003/0059717 A1 * 3/2003 Tabuchi et al. ..... 430/302
2003/0076395 A1 * 4/2003 Onishi et al. ..... 347/101
2003/0137572 A1 * 7/2003 Miyamoto et al. ..... 347/102

FOREIGN PATENT DOCUMENTS

JP 60-23096 2/1985
JP 60-189486 9/1985
JP 61-230973 10/1986
JP 07-276686 10/1995
JP 2001-10212 1/2001
JP 2001-270257 10/2001
JP 2001-341862 12/2001
JP 2002-113853 4/2002
JP 2002195248 A * 7/2002

OTHER PUBLICATIONS

Patent Abstracts of Japan 07-276686 Dated Oct. 24, 1995.

(Continued)

*Primary Examiner*—Stephen Meier
*Assistant Examiner*—Leonard Liang
(74) *Attorney, Agent, or Firm*—Ladas and Parry LLP

(57) ABSTRACT

The transferring pressure roll comprises a roll main body and an elastic material layer which covers the surface of the roll main body and comes in contact with a transferring film during pressing and the hardness of the elastic material constituting the elastic material layer is set in a value less than HA40 as measured by the measuring method defined in JIS-K6253.

15 Claims, 4 Drawing Sheets

OTHER PUBLICATIONS

Patent Abstracts of Japan 2001-270257 Dated Oct. 2, 2001.
Patent Abstracts of Japan 07-276686 Dated Oct. 24, 1995.
Patent Abstracts of Japan 2001-270257 Dated Oct. 2, 2001.
Japanese Official Action dated Jun. 27, 2006 in Japanese Application No. 2003-335547 with English Translation.
Japanese Official Action dated Jun. 27, 2006 in Japanese Application No. 2003-014080 with English Translation.
Patent Abstract of JP 2001-10212.
Patent Abstract of JP 2002-113853.
Patent Abstract of JP 2001-341862.

* cited by examiner

TRANSFERRING PRESSURE ROLL, TRANSFERRING UNIT AND INK JET RECORDING APPARATUS

BACKGROUND OF THE INVENTION

1. Technical Field to which the Invention Belongs

The present invention relates to a transferring pressure roll and a transferring unit for use in the provision of a protective layer for covering an image (ink jet image) formed on a recording medium by an ink jet recording method and an ink jet recording apparatus comprising the transferring unit.

2. Related Art

An ink jet recording process is a printing process which comprises ejecting ink droplets from a minute jet nozzle of recording head onto a recording medium such as paper to which they are then fixed to form an image. In recent years, as a recording medium for ink jet recording there has been developed an ink jet recording paper comprising an ink-receiving layer mainly composed of a porous particulate material such as silica and alumina provided on a base such as paper and film. Such an ink jet recording paper can provide a high quality ink jet-recorded image comparable to silver salt system photograph. However, such an ink jet recording paper is inferior to silver salt system photograph in preservability (weathering resistance, gas resistance, friction resistance, etc.). The preservability of ink jet-recorded image has been considered important more and more with the expansion of application of ink jet recording technique to digital photographic service, commercial printing, etc. The provision of ink jet-recorded images which can be stored over an extended period of time is an important assignment of ink jet recording technique.

As a technique for enhancing the preservability or gloss of ink jet-recorded images there has been known a method which comprises laminating a transparent film or the like on a recorded material on the ink jet image surface thereof (ink jet-recorded image surface) to form a protective layer for covering the ink jet-recorded image. Examples of the film lamination method include a cold lamination method which comprises peeling a back paper (separator) off a normally adhesive film while laminating the adhesive film on the image surface, a heat (hot) lamination method which comprises laminating a thermoplastic resin film without back paper on the image surface while heating the thermoplastic resin film, and a heat transfer method which comprises subjecting a transferring film comprising a transparent film (transferable protective layer) provided on a heat-resistant substrate to heat transfer so that the transparent film is transferred to the image surface. Among these film lamination methods, the heat transfer method can form a thinner protective layer than the other lamination methods can. Thus, unlike the other lamination methods, the heat transfer method doesn't provide the image surface with excessive feeling of gloss. Accordingly, the heat transfer method has been noted as a lamination method which can enhance the preservability or gloss of image without impairing the inherent feeling or texture of recorded material. Examples of references of related art technique concerning the heat transfer method include JP-A-60-23096, JP-A-60-189486, and JP-A-61-230973.

Referring to the principle of the heat transfer method, a recorded material and a transferring film are normally laminated on each other in such an arrangement that the ink jet-recorded image surface and the transferable protective layer are opposed to each other to form a laminated sheet as shown in FIG. 6. The laminated sheet is then passed through the nip between a metallic heat pressure roll and a metallic receiving roll so that the transferable protective layer is fused and press-bonded to the ink jet-recorded image surface. The heat-resistant substrate is then peeled off the laminated sheet to obtain a desired recorded material with protective layer.

It is important in the aforementioned heat transfer method that there can be obtained a sufficient adhesion between the ink jet-recorded image surface and the transferable protective layer. However, this heat transfer method is disadvantageous in that if the ink jet-recorded image surface to which the transferable protective layer is transferred is a less smooth surface having a fine roughness (so-called finely roughened surface), the related art transferring unit can difficultly cause the molten transferable protective layer to enter in the indentation of roughened surface under heating and pressing, making it impossible to press-bond the transferable protective layer onto the ink jet-recorded image surface (finely roughened surface) with a good adhesion. As a result, bubbles enter in the gap between the ink jet-recorded image surface and the transferable protective layer. The heat transfer method is also disadvantageous in that when pressed by the aforementioned heat pressure roll, the raised portions on the finely roughened surface are crushed to level the roughness, impairing the inherent feeling or texture of recorded material.

SUMMARY OF THE INVENTION

It is therefore an aim of the invention to provide a transferring pressure roll and a transferring unit capable of press-bonding a transferable protective layer onto an ink jet-recorded image formed on a finely roughened surface having a fine roughness with a good adhesion without causing the entrance of bubbles or leveling the roughened surface and hence enhancing the preservability of the ink jet-recorded image without impairing the inherent texture thereof and an ink jet recording apparatus comprising the transferring unit.

The transferring pressure roll of the invention is adapted to press a laminated sheet comprising a recording material having an ink jet-recorded image surface with numeral raised portions having a height of from 5 to 20 μm formed on a recording sheet at a pitch of from 50 to 500 μm and a transferring film having a transferable protective layer provided on a heat-resistant substrate made of a polyethylene terephthalate film laminated on each other in such an arrangement that the ink jet recording surface and the transferable protective layer are opposed to each other on the transferable film side thereof under heating to press-bond the transferable protective layer onto the ink jet recording surface, wherein there are incorporated a cylindrical roll main body and an elastic material layer which covers the surface of the roll main body and comes in contact with the transferring film during pressing and the hardness of the elastic material constituting the elastic material layer is set in a value less than HA40 as measured by the measuring method defined in JIS-K6253.

Further, the transferring unit of the invention comprises a laminated sheet forming portion for feeding a transferring film having a transferable protective layer provided on a heat-resistant substrate made of a polyethylene terephthalate film onto a recording material having an ink jet-recorded image surface with numeral raised portions having a height of from 5 to 20 μm formed on a recording sheet at a pitch of from 50 to 500 μm on the ink jet-recorded image surface side thereof in such an arrangement that the ink jet recording surface and the transferable protective layer are opposed to each other so that the recorded material and the transferring film are laminated to form a laminated sheet provided with the recorded material and the transferring film; a press-bonding portion for heating the laminated sheet under pressure to press-bond the transferable protective layer onto the ink jet-recorded image surface; and a peeling portion for peeling the heat-resistant substrate off the laminated sheet which has been passed through the press-bonding portion, wherein the press-bonding portion comprises a transferring pressure roll as defined in the above and a receiving member and is arranged such that the laminated sheet is passed through the gap between the transferring pressure roll and the receiving member.

Moreover, the ink jet recording apparatus of the invention comprises an ink jet recording portion for hitting an ink onto a recording sheet comprising a recording surface having numeral raised portions having a height of from 5 to 20 μm formed thereon at a pitch of from 50 to 500 μm to form an ink jet image thereon and a protective layer forming portion for subjecting a transferring film comprising a transferable protective layer provided on a heat-resistant substrate made of a polyethylene terephthalate film to heat transfer so that the transferable protective layer is transferred onto the recording surface on which the ink jet image has been formed, wherein the protective layer forming portion is formed by a transferring unit as defined in the above.

In accordance with the invention, a transferable protective layer can be press-bonded onto an ink jet-recorded image formed on a finely roughened surface having a fine roughness with a good adhesion without causing the entrance of bubbles or leveling the roughened surface, making it possible to enhance the preservability of the ink jet-recorded image while maintaining the inherent feeling or texture thereof.

In some detail, since the hardness of the elastic material constituting the elastic material layer adapted to come in contact with a transferring film (heat-resistant substrate) comprising a polyethylene terephthalate film as a heat-resistant substrate during pressing of a laminated sheet in heat-transfer process film lamination involving the use of the transferring film is set in a value less than HA40 as measured by the measuring method defined in JIS-K6253, the transferring pressure roll of the invention cannot crush the raised portions on the roughened surface of the ink jet-recorded image even when the laminated sheet is pressed. Further, since the transferable protective layer which has been heated and melted can follow and get fully adapted to the roughness of the ink jet-recorded image, the transferable protective layer can be press-bonded to the ink jet-recorded image with a good adhesion. A polyethylene terephthalate film exhibits a good heat resistance and a high mechanical strength and thus is a material which can be preferably used as a heat-resistant substrate (support) for this kind of a transferable film.

Moreover, the transferring unit of the invention and the ink jet recording apparatus comprising the transferring unit have the aforementioned transferring pressure roll as a roll for pressing the laminated sheet on the transferring film side thereof, a recorded material with a protective layer having an excellent adhesion can be produced stably at a relatively low cost.

DETAILED DESCRIPTION OF PREFERRED EMBODIMENTS

Figure 1:
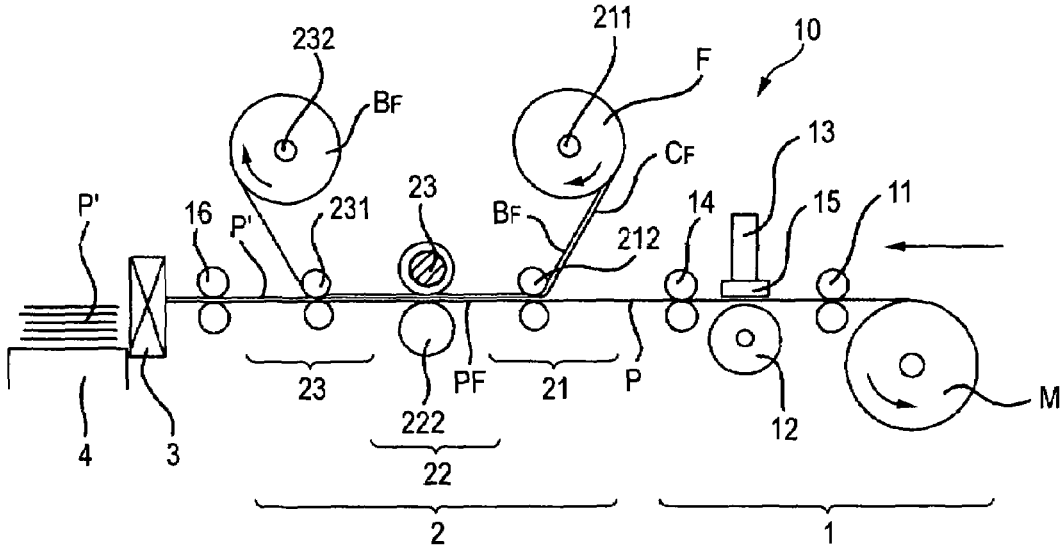
FIG. 1 is a side view typically illustrating the essential part of an embodiment of the ink jet recording apparatus of the invention.
Figure 2:
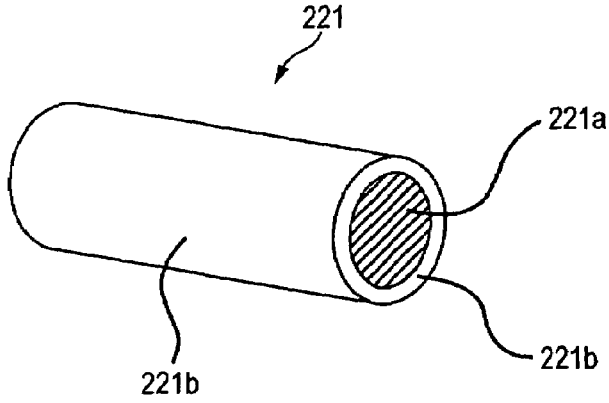
FIG. 2 is a perspective view of the pressure roll of the transferring unit shown in FIG. 1.

The transferring pressure roll and transferring unit of the invention will be further described with the ink jet recording apparatus comprising the transferring unit in connection with FIGS. 1 and 2.

FIG. 1 is a side view typically illustrating the essential part of an embodiment of the ink jet recoding device of the invention. The ink jet recording apparatus 10 shown in FIG. 1 comprises an ink jet recording portion 1 for injecting an ink onto the recording surface of a recording sheet M to form an ink jet-recorded image thereon and a protective layer forming portion 2 for subjecting an image protective film F comprising a transferable protective layer CF provided on a heat-resistant substrate BF to transfer so that the transferable protective layer CF is transferred onto the recording surface (ink jet-recorded image) on which the ink jet-recorded image has been formed to form a protective layer. Provided downstream from the protective layer forming portion 2 along the conveyance path of the recording sheet M are autocutter 3 for cutting a continuous sheet into a unit length and a discharged paper tray 4 for stocking a plurality of sheets having a unit length. The protective layer forming portion 2 itself is a so-called film transferring unit. Referring to the basic configuration of the ink jet recording apparatus 10, the aforementioned transferring unit is incorporated in an ink jet recording apparatus adapted for roll paper.

The ink jet recording portion 1 is arranged such that a pair of paper feed rolls 11 cause a recording sheet M to be wound off the roll and fed to a platen 12 where various inks are then injected from an ink jet head 13 onto the recording surface thereof to form an ink jet-recorded image thereon, thereby preparing a recorded material P which is subsequently conveyed into a protective layer forming portion (transferring unit) 2 through a pair of paper feed rolls 14. The paper feed rolls 11 and 14 are connected to each other via a motor (not shown) and a belt or chain (not shown) for transmitting driving power. Such a conveyance mechanism can cause the recording sheet M to be fed to or back from the protective layer forming portion 2.

In FIG. 1, the reference numeral 15 indicates a carriage carrying the aforementioned ink jet head 13. The carriage 15 is retained slidably on a guide rail (not shown) disposed perpendicular to the conveyance direction of the recording sheet M and is connected to a drive transmission belt (not shown) which is driven by a carriage motor (not shown) as in an ordinary serial scanning type ink jet recording apparatus. Such a head driving mechanism can cause the ink jet head 13 to scan the recording surface of the recording sheet M in the direction perpendicular to the conveyance direction of the recording sheet M.

The ink jet head 13 maybe operated in a continuous process which comprises deflecting the flow of ink droplets ejected continuously at a constant interval of time to form an image or an on-demand process which comprises ejecting ink droplets according to image data. Examples of the ink ejection process include a process which uses a voltage generated by a piezoelectric element to control the ejection of ink droplets, and a process which uses a thermal energy generated by a heat-generating resistor to control the ejection of ink droplets. However, the invention is not limited to these ejection processes. The ink jet head 13 may be of cartridge type integrally provided with an ink tank or a type which is supplied with an ink through a tube or the like from an ink tank provided separately of the ink jet head.

The protective layer forming portion (transferring unit) 2 comprises a laminated sheet forming portion 21 for feeding the aforementioned transferring film F onto the recorded material P prepared in the ink jet recording portion 1 on the ink jet-recorded image surface side thereof in such an arrangement that the ink jet-recorded image and the aforementioned transferable protective layer CF are opposed to each other so that the recorded material F and the transferring film F are laminated to form a laminated sheet PF comprising the recorded material F and the transferable protective layer CF, a press-bonding portion 22 for heating the laminated sheet PF under pressure to press-bond the transferable protective layer CF onto the ink jet-recorded image surface and a peeling portion 23 for peeling the heat-resistant substrate BF off the laminated sheet PF which has been passed through the press-bonding portion 22.

The laminated sheet forming portion 21 comprises a feed roll 211, a transferring film F wound on the feed roll 211, and an angle adjusting roll 212. The feed roll 211 acts as a center of rotation for the roll of the transferring film F during the feed of the film. The angle adjusting roll 212 is disposed movable somewhat horizontally and vertically with its central axis being kept perpendicular to the conveyance direction of the recorded material P. By moving the angle adjusting roll 212 to a proper position as necessary, the angle at which the transferring film F being wound off the roll is fed onto the recorded material P can be properly adjusted. The transferring film F is wound off the roll by a pair of feed rolls (not shown) between which it is interposed. In this arrangement, the transferring film F is fed to or back from the angle adjusting roll 212. These feeding rolls are connected to a motor (not shown) via a drive transmission belt or chain (not shown) so that they are driven by the motor to convey the transferring film F.

The press-bonding portion 22 comprises a pressure roll 221, and a receiving roll (receiving member) 222 disposed opposed to the pressure roll 221 with a predetermined gap interposed therebetween and is arranged such that the laminated sheet F is passed through the gap between the pressure roll 221 and the receiving roll 222. The pressure roll 221 is disposed above the laminated sheet PF which is being conveyed and acts to press the laminated sheet PF on the transferring film F side thereof while being in contact with the heat-resistant substrate BF. The receiving roll 222 is adapted to receive the laminated sheet PF under pressure. The pressure roll 221 and the receiving roll 222 each are a roll having a circular section (cylindrical) and an axial length which is the same as or longer than the width of the laminated sheet PF. These rolls are disposed in such an arrangement that their axes are perpendicular to the conveyance direction of the laminated sheet PF. The pressure roll 221 is connected to a motor (not shown) via a gear mechanism (not shown) and is driven by this motor. By thus driving the pressure roll 221, the gap between the two rolls can be arbitrarily predetermined. In this arrangement, the two rolls can be brought into pressure contact with each other to form a nip (clamping portion) at a predetermined nip pressure. When the laminated sheet PF is passed through the nip, it is uniformly heated under pressure as a whole. It is not necessarily required that the diameter of the pressure roll 221 and the receiving roll 222 be the same as shown in FIG. 1. The diameter of these rolls may be properly changed.

The pressure roll 221 is formed by a roll main body 221*a* and an elastic material layer 221*b* covering the surface of the roll main body 221*a* as shown in FIG. 2. The roll main body 221*a* comprises a heat source such as heater provided in the interior of a cylindrical hollow aluminum material (so-called heat roll) and is arranged such that the transferable protective layer CF is heated through the elastic material layer 221*b* and the heat-resistant substrate BF to an extent such that it becomes adhesive under pressure on the laminated sheet PF. The material of the roll main body 221*a* is not limited to aluminum but may be carbon steel, stainless steel or the like.

The elastic material layer 221*b* is formed by an elastic material. The hardness of the elastic material is set in a value less than HA40 as measuredly the measuring method defined in JIS-K6253 (or ASTM-D2240). When the hardness of the elastic material is HA40 or more, a sufficient adhesion between the transferable protective layer and the recorded material cannot be obtained, possibly causing the entrance of bubbles or the leveling of the roughened surface. On the contrary, when the hardness of the elastic material is too low, the width of nip under pressure increases, resulting in the drop of pressure that causes the entrance of bubbles and hence makes it impossible to effect sufficient transfer. Therefore, the lower limit of the hardness of the elastic material according to JIS-K6253 (or ASTM-D2240) is preferably about HA5. Accordingly, the hardness of the elastic material is preferably from about HA10 to HA30.

The aforementioned defined range of the hardness of the elastic material (less than HA40) was found as a result of studies of realization of good heat transfer in heat transfer process film lamination using a transferring film comprising a polyethylene terephthalate (PET) film as a heat-resistant substrate. In some detail, conditions under which a transferable protective layer is press-bonded onto an ink jet-recorded image formed on a finely roughened surface having a fine roughness with a good adhesion without causing the entrance of bubbles or leveling the roughness differ with the properties of the heat-resistant substrate. Focusing on PET film having excellent properties as a heat-resistant substrate, the invention provides as a transferring pressure roll which can realize good heat transfer in heat transfer process film lamination using a transferring film comprising PET film as a heat-resistant substrate a transferring pressure roll comprising an elastic material layer formed by an elastic material having a hardness of less than HA40. Accordingly, the transferring pressure roll of the invention is useful particularly for transferring films comprising PET film as a heat-resistant substrate.

As the aforementioned elastic material there may be used silicone rubber, natural rubber, synthetic natural rubber, styrene rubber, butadiene rubber, chloroprene rubber, butyl rubber, nitrile rubber, ethylene propylene rubber, fluororubber or the like from the aforementioned specific range of hardness. Particularly preferred among these rubbers is silicone rubber from the standpoint of releasability of the surface of the resulting roll, workability, cost, etc.

The elastic material layer 221*b* may be a single-layer structure made of a single elastic material or a multi-layer structure comprising a plurality of elastic materials laminated on each other.

The thickness of the elastic material layer 221*b* is preferably from 0.2 to 5 mm, more preferably from 0.5 to 1 mm. In the case where the elastic material layer 221*b* has a multi-layer structure, the thickness of the entire multi-layer structure is arranged to fall within the above defined range. When the thickness of the elastic material layer 221*b* falls below 0.2 mm, the resulting lack of elasticity can cause the entrance of bubbles or the leveling of roughness. On the contrary, when the thickness of the elastic material layer 221*b* exceeds 5 mm, the width of nip shows a drastic rise (nip pressure drops), possibly causing the entrance of bubbles, the leveling of roughness, the deterioration of adhesion of the transferable protective layer to the ink jet-recorded image, etc. Further, the resulting elastic material layer 221*b* exhibits a lowered heat conductivity that possibly causes maltransfer.

The receiving roll 222 is a metallic roll having a smooth surface. As the material of the metallic roll there is often used carbon steel, but the invention is not limited thereto. The surface of the metallic roll may be coated with a fluororesin or may be otherwise treated to have a high releasability. Alternatively, ceramics, chromium or the like may be flame-sprayed onto the surface of the metallic roll. As the receiving roll 222 there may be used a roll made of such a metallic material coated with an elastic material layer. As the elastic material layer for this metallic roll there may be used the same material as used in the pressure roll 221.

The peeling portion 23 comprises an angle adjusting roll 231 for adjusting the peeling angle of the heat-resistant substrate BF and a wind-up roll 232 for winding the heat-resistant substrate BF thus peeled. The angle adjusting roll 231 is disposed movable somewhat horizontally and vertically and is arranged so as to properly adjust the peeling angle as in the aforementioned angle adjusting roll 212. The heat-resistant substrate BF which has been peeled off the laminated sheet PF is conveyed while being clamped between a pair of feed rolls (not shown) connected to a motor (not shown) through a drive transmission belt or chain (not shown) to the wind-up roll 232 on which it is then wound and recovered.

Provided at the rear of the peeling portion 23 is a pair of paper feed roll 16 by which a recorded material P' with protective layer which has been prepared through the peeling portion 23 can be fed to or back from the autocutter 3 while being clamped therebetween. The paper feed rolls 16 are connected to a motor (not shown) through a drive transmission belt or chain (not shown) and are driven by this motor to convey the recorded material P' with protective layer.

The autocutter 3 comprises a cutter, a support, a guide member and other members which are not shown and is adapted to cut a continuous sheet (recorded material P' with protective layer) into a predetermined length. For the measurement of the length of the sheet, a detecting sensor is used. In some detail, the forward end of the sheet is detected by the detecting sensor. The length of the sheet can then be measured taking into account the rotary speed of the motor, etc. The sheet is cut into a predetermined length according to the measurements, and then conveyed into the discharged paper tray 4.

The transferring film F, which is one of the constituent members of the protective layer forming portion (transferring unit), will be further described hereinafter. As mentioned above, the transferring film F comprises the heat-resistant substrate BF and the transferable protective layer CF provided on the heat-resistant substrate BF which is press-bonded onto the ink jet-recorded image in the aforementioned press-bonding portion 22.

As the heat-resistant substrate BF there is used PET film as mentioned above. The PET film has properties required for heat-resistant substrate in transferring film, e.g., heat resistance and mechanical strength which are high enough to keep the film stable in shape under predetermined heating and pressing conditions during lamination and good releasability from the transferable protective layer CF press-bonded onto the ink jet-recorded image, and thus can be used as a heat-resistant substrate to advantage. Further, the PET film has a low rigidity as compared with a release paper (raw paper coated with a silicone resin, fluororesin or the like) which is widely used as this kind of heat-resistant substrate and thus can follow the roughness. Thus, by using PET film as heat-resistant substrate BF, the adhesion of the transferable protective layer CF to the finely roughened surface (ink jet-recorded image) can be enhanced. The thickness of the heat-resistant substrate BF (PET film) is preferably from 4 to 20 μm, more preferably from 5 to 15 μm. When a PET film having a thickness of not smaller than 100 μm is used, it can cause maltransfer because it has a poor heat conductivity.

If necessary, the heat-resistant substrate BF may comprise a particulate ceramic incorporated therein or may be coated with a vinyl-based resin such as polyester-based resin, polyacrylic acid ester-based resin, polyvinyl acetate-based resin, polyurethane-based resin, styrene acrylate-based resin, polyacrylate-based resin, polyacrylamide-based resin, polyamide-based resin, polyether-based resin, polystyrene-based resin, polyethylene-based resin, polypropylene-based resin, polyolefin-based resin, polyvinyl chloride resin and polyvinyl alcohol resin, a cellulose-based resin such as cellulose resin, hydroxyethyl cellulose resin and cellulose acetate resin, a polyvinyl acetal-based resin such as polyvinyl acetoacetal resin and polyvinyl butyral resin or a heat-resistant resin such as silicone-modified resin and long-chain alkyl-modified resin to further enhance the heat resistance thereof. The heat-resistant substrate BF may be subjected to various surface treatments such as release treatment with silicone or the like, antistatic treatment, corona discharge treatment and embossing on the surface thereof on which the transferable protective layer CF is formed to enhance the transferability and the surface designability of the transferable protective layer and prevent the electrostatic attraction of dust.

The transferable protective layer CF is a layer made of a resin which is heat-transferred onto the ink jet-recorded image surface of the recorded material to act as a protective layer. As such a resin there is preferably used a resin capable of forming a coat layer having an excellent adhesion to the recorded material and chemical/physical barrier properties and a high transparency which can be difficultly discolored by heat or light. Preferred examples of the material constituting the transferable protective layer CF include acrylic copolymer, acryl-styrene copolymer, vinyl acetate resin, vinyl acetate copolymer, vinyl chloride-vinyl acetate copolymer, vinyl chloride-acryl copolymer, vinyl acetate-acryl copolymer, and acryl-silicone copolymer. These materials may be used singly or in admixture of two or more thereof.

The transferable protective layer CF may be a single-layer structure made of a single resin layer or a multi-layer structure having a plurality of resin layers laminated on each other.

The thickness of the transferable protective layer CF is preferably as small as possible from the standpoint of enhancement of adhesion to the ink jet-recorded image surface and prevention of the deterioration of the inherent feeling or texture of the recorded material and the deterioration of image quality. However, when the thickness of the transferable protective layer CF is too small, the resulting protective layer exhibits a deteriorated performance. From this standpoint of view, the thickness of the transferable protective layer CF is preferably from 2 to 20 μm, more preferably from 4 to 10 μm. In the case where the transferable protective layer CF has a multi-layer structure, the thickness of the entire multi-layer structure is predetermined to fall within the above defined range. The thickness of the transferable protective layer CF changes little and falls substantially within the above defined range when transferred onto the ink jet-recorded image to act as a protective layer.

If necessary, the transferable protective layer CF may comprise one or more of various additives such as dye, pigment, release agent, wetting agent, anti-foaming agent, dispersant, antistatic agent, ultraviolet absorber, oxidation inhibitor, fluorescent dye and fluorescent brightener incorporated therein besides the resin component.

The transferring film F can be produced by adding one or more of the aforementioned resins and optionally the aforementioned various additives to a proper solvent such as water to prepare a coating solution, spreading the coating solution over the heat-resistant substrate BF, and then drying the coated substrate to form a transferable protective layer CF on the heat-resistant substrate BF. While the transferable protective layer CF is normally formed on the entire surface of the heat-resistant substrate BF, it may be formed on a part of the surface of the heat-resistant substrate BF. The spreading of the coating solution can be accomplished by the use of any of various coating devices such as blade coater, die coater, reverse roll coater, gravure roll coater, air knife coater, bar coater, rod blade coater, curtain coater, short dwell coater, size press and spray.

The operation of various portions during the operation of the ink jet recording apparatus 10 having the aforementioned constitution will be described in connection with FIG. 1.

When receiving image data transmitted by a host computer (not shown), the ink jet recording apparatus 10 drives the recorded sheet M to be wound off the roll and conveyed into the ink jet recording portion 1 where various inks are then injected there onto by the ink jet head 13 to form an ink jet-recorded image. An ink jet-recorded image is formed on the recording surface of the recording sheet M to form a recorded material P which is then conveyed into the protective layer forming portion (transferring unit) 2.

In the protective layer forming portion (transferring unit) 2, the transferring film F is fed onto the ink jet-recorded image surface of the recorded material P at the laminated sheet forming portion 21 in such an arrangement that the ink jet-recorded image surface and the transferable protective layer CF are opposed to each other so that the recorded material P and the transferring film F are laminated on each other with the ink jet-recorded image surface interposed therebetween to form a laminated sheet PF. Subsequently, the laminated sheet PF is passed through the nip between the pressure roll 221 and the receiving roll 222 under heating and pressure at the press-bonding portion 22. The heating temperature and linear pressure during this procedure may be properly adjusted taking into account the material, thickness, etc. of the transferring film F used. For example, in the case where as the heat-resistant substrate there is used a PET film having a thickness of from 4 to 20 μm and as the transferable protective layer there is used an acryl copolymer layer having a thickness of from 2 to 20 μm, the heating temperature (surface temperature of the elastic material layer 221*b*) and the linear pressure are preferably from about 90° C. to 110° C. and from about 5 to 10 kN/m, respectively. In accordance with the invention, the use of the pressure roll having the aforementioned constitution makes it possible to effect heat transfer at lower temperature and pressure than in the case where a related transferring unit is used. When the laminated sheet PF is heated under pressure at the press-bonding portion 22, the transferable protective layer CF is melted and bonded to the ink jet-recorded image surface. When the transferable protective layer CF cools down to fix itself firmly to the ink jet-recorded image surface, the heat-resistant substrate BF is then peeled off the laminate at the peeling portion 23 to obtain a recorded material P' with protective layer.

The recorded material P' with protective layer in a continuous length thus obtained is cut by the autocutter 3 into sheets having a predetermined length which are then stocked on the discharged paper tray 4.

While the aforementioned embodiment is applied to a recording sheet in a continuous length (so-called roll paper), a protective layer can be similarly formed also on sheet-cut recording sheets having a size of A4 or the like.

In the invention, transfer can be conducted also on a high gloss recorded material having a high smooth ink jet-recorded image surface without any troubles. The invention is effective particularly for recorded materials having a finely roughened and less smooth ink jet-recorded image surface. Such a recorded material can be obtained by injecting inks onto a recording sheet having a "recording surface with numeral raised portions having a height of from 5 to 20 μm formed thereon at a pitch of from 50 to 500 μm" (hereinafter referred to as "finely roughened surface") on the finely roughened surface thereof by an ink jet recording process to form an ink jet-recorded image. This finely roughened surface is also referred to as "raster surface" and has a half-gloss tone. A recording sheet having such a finely roughened surface is used to output a silver salt photograph tone ink jet image or the like.

Figure 3A:
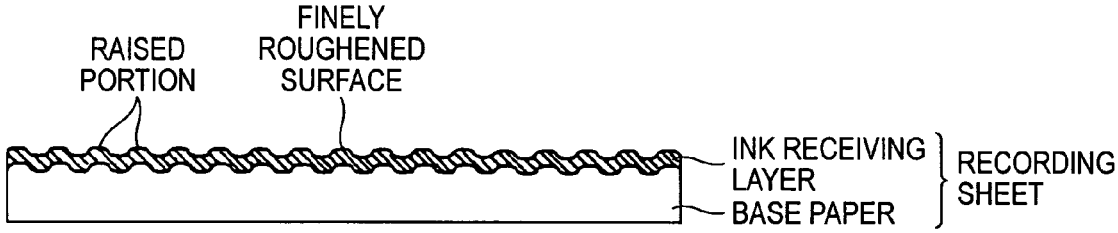
FIG. 3A is a typical sectional view of an example of a recording sheet having a finely roughened surface and FIG. 3B is an enlarged view of a part of the surface of the recording sheet.
Figure 3B:
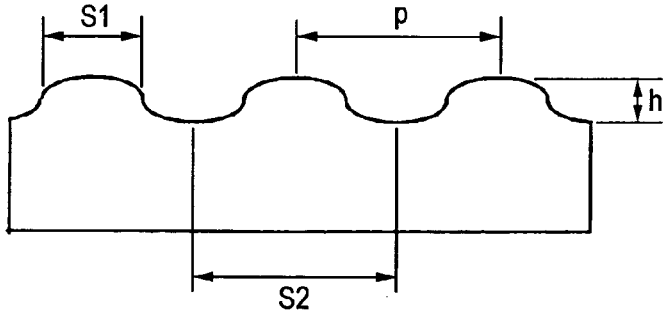

An example of the aforementioned recording sheet is shown in FIGS. 3A and 3B. The application of the invention is not limited to the recording sheet shown in FIGS. 3A and 3B. FIG. 3A is a typical sectional view of a recording sheet. FIG. 3B is an enlarged view of a pat of the surface of the recording sheet shown in FIG. 3A. In FIG. 3B, h indicates the height of raised portion (5 to 20 μm), p indicates the pitch of raised portions (distance between raised portions: 50 to 500 μm), S1 indicates the sectional area of the top of raised portion, and S2 indicates the sectional area of the base of raised portion. While S1 is smaller than S2 in FIGS. 3A and 3B, the relationship between S1 and S2 can be arbitrarily predetermined. The shape (shape of horizontal section) of raised portion may be any of circle, ellipsoid, cube, rectangle, rhomb and ridgeline and is not specifically limited.

The recording sheet having such a finely roughened surface can be obtained by embossing the surface of a base paper such as high quality paper, art paper, coated paper, cast coated paper and resin-coated paper having a resin layer of polyethylene or the like provided on one or both sides of paper (also referred to as "RC paper") over an embossing roll engraved with a predetermined pattern or the like, and then forming an ink-receiving layer on the embossed surface as the base paper there is preferably used a resin-coated paper having an excellent waviness-proofness after printing. Embossing may be made on the surface of an ink-receiving layer formed on the surface of an unembossed base paper. Any of these methods may be used to finely roughen the surface of the ink-receiving layer.

The surface of the aforementioned base paper on which the ink-receiving layer is formed is preferably embossed such that the 75° mirror surface gloss falls below 30%, preferably from 10% to 28% as defined according to JIS-P8142. In some detail, the central surface average roughness (SRa) of the ink-receiving layer-forming surface is preferably greater than 0.5, more preferably from 0.7 to 5.0, even more preferably from 0.8 to 4.5. In the recording sheet comprising such a base paper, the ink-receiving layer has a finely roughened surface as mentioned above to give a unique feeling of half gloss tone. Thus, the recording sheet is suitable particularly for the output of silver salt photograph tone recorded matters. The central surface average roughness (SRa) indicates SRa value measured at a cutoff value of 0.8 mm using a feeler type three-dimensional surface roughness meter and is determined by the following equation.

$$SRa = \frac{1}{Sa}\int_0^{Wx}\int_0^{Wy} |f(X, Y)|\, dX,\ dY \qquad \text{[Equation 1]}$$

wherein Wx represents the length of the sample surface in the direction of x axis; Wy represents the length of the sample surface in the direction of y axis; and Sa represents the area of the sample surface.

In some detail, using a Type SE-3AK feeler type three-dimensional surface roughness meter and a Type SPA-11 three-dimensional roughness analyzer (produced by Kosaka Laboratory Ltd.) as the feeler type three-dimensional surface roughness meter and three-dimensional roughness analyzer, respectively, the central surface average roughness (SRa) can be determined at a cutoff value of 0.8 mm, Wx of 20 mm, Wy of 8 mm, i.e., Sa of 160 $mm^2$.

The ink-receiving layer formed on the aforementioned base paper comprises porous amorphous silica, porous magnesium carbonate, porous alumina or the like as a main component. The content of the main component is from about 40 to 90% by weight. The ink-receiving layer normally comprises a binder resin such as polyvinyl alcohol as well incorporated therein to provide the coat layer with required strength. The thickness of the ink-receiving layer is from about 20 to 50 μm.

As the ink for forming an ink jet-recorded image on the finely roughened surface there may be used any of dye ink and pigment ink so far as it is adapted for ink jet recording. In general, pigment inks are superior to dye inks in light-resistance and water resistance of recorded image. Therefore, when pigment inks are used to form an ink jet-recorded image, these properties of pigment inks, combined with the effect of the aforementioned protective layer, make it possible to obtain an ink jet-recorded image having an extremely excellent long-term preservability. In order to form a color ink jet-recorded image, inks of subtractive primaries, i.e., yellow, magenta and cyan, and optionally black and other colors are used.

The transferring pressure roll of the invention comprises a cylindrical roll main body and an elastic material layer which covers the surface of the roll main body and comes in contact with the aforementioned transferring film during pressing. It suffices if the hardness of the elastic material constituting the elastic material layer is set in a value less than HA40 as determined by the measuring method defined in JIS-K6253. Various changes may be made in the transferring pressure roll without departing from the scope and spirit of the invention. While the aforementioned embodiment has been described with reference to the case where the pressure roll 221 is a so-called heat roll comprising a heating source provided there inside, the pressure roll 221 may not have such a heating capacity. In this case, however, it is necessary that a separate heating unit be provided in the vicinity of the pressure roll. It goes without saying that even if the pressure roll has a heating capacity, a similar heating source may be additionally provided.

The ink jet recording apparatus and transferring unit (protective layer forming portion in ink jet recording apparatus) of the invention are not limited to the aforementioned embodiment. Various changes may be made in the shape, mounting site and mounted number of the various constituent members without departing from the scope and spirit of the invention. While the aforementioned embodiment has been described with reference to the case where the press-bonding portion comprises a pair of rolls (pressure roll 221 and receiving roll 222), a plurality of these pairs of rolls may be provided. While the aforementioned embodiment has been described with reference to the case where the receiving member is a cylindrical roll, it is merely essential that the receiving member be arranged so as to nip (clamp) the sheet material. The receiving member may be a tabular body having a smooth surface to be pressed. The material of the tabular material may be metallic, but the invention is not limited thereto.

A cooling unit such as cooling fan and radiator may be provided between the press-bonding portion 22 and the peeling portion 23 (between the pressure roll 221 and the angle adjusting roll 231). The disposition of such a cooling unit makes it possible to rapidly cool the laminated sheet PF which has been heated under pressure at the press-bonding portion 22 and hence expect the enhancement of gloss of the protective layer and adhesion of the protective layer to the ink jet-recorded image besides the enhancement of the speed of the production line.

The transferring film F may comprise a release layer having a thickness of from about 0.5 to 5 μm mainly composed of colloidal silica or the like provided interposed between the heat-resistant substrate BF and the transferable protective layer CF to enhance the transferability of the transferable protective layer CF. The heat-resistant substrate BF may comprise a heat-resistant substrate slip layer provided on the back surface thereof (surface on which the transferable protective layer CF is not provided) for the purpose of preventing the heat fusion of the heat roll, etc. to the heat pressing device, enhancing the blocking resistance of the heat-resistant substrate BF or improving the slipperiness of the transferring film during paper feed. The heat-resistant slip layer can be formed by spreading a silicone resin or the like. The thickness of the heat-resistant slip layer is normally from about 0.1 to 10 μm.

EXAMPLE

The invention will be further described in the following examples, but the invention should not be construed as being limited thereto.

Example 1

A thermoplastic resin emulsion ("Acritto 4635", produced by DAICEL CHEMICAL INDUSTRIES, LTD.) was uniformly spread over the whole of one side of a PET film (thickness: 12 μm) as a heat-resistant substrate to a dry thickness of 8 μm using a wire bar, and then dried to form a transferable protective layer on the PET film. Thus, a transferring film was prepared.

As a recording sheet having a finely roughened surface there was used a commercially available ink jet recording paper comprising a polyolefin resin-coated paper as a base paper (trade name "Premium Luster Photo Paper", produced by Epson America, Inc.; 75° mirror surface gloss and SRa value of polyolefin resin-coated paper are 25% and 1.5, respectively, according to JIS-P8142). Using a pigment ink jet printer (trade name "MC2000", produced by SEIKO EPSON CORPORATION), a color patch of cyan, magenta, yellow and black was then printed on the ink-receiving layer of the ink jet recording paper to prepare a recorded material.

Subsequently, the aforementioned transferring film and the aforementioned recorded material were laminated on each other in such an arrangement that the transferable protective layer and the ink jet-recorded image surface were opposed to each other to form a laminated sheet. The laminated sheet thus prepared was then passed through the nip between a pressure roll and a receiving roll as arranged in FIG. 1 so that it was heated under pressure to undergo press-bonding. The PET film was then peeled off the laminate at a peeling angle (angle between PET film and transferable protective layer) of 150° and a peeling rate of 10 mm/sec to prepare a recorded material with protective layer. The conditions under which the laminated sheet is subjected to press-bonding are as follows (press-bonding condition 1).

(Press-bonding Condition 1)

Pressure roll (heat roll): The surface of a roll comprising a steel core was coated with a silicone rubber (HA30) to a thickness of 0.5 mm to prepare a pressure roll.

Receiving roll: The surface of a roll comprising a steel core was coated with a silicone rubber (HA80) to a thickness of 5 mm to prepare a receiving roll.

Surface temperature of pressure roll: 100° C.; linear pressure: 10 kN/m; passing velocity of laminated sheet: 10 mm/sec Example 2

A recorded material with protective layer was prepared in the same manner as in Example 1 except that the laminated sheet was subjected to press-bonding in the following manner (press-bonding condition 2).

(Press-bonding Condition 2)

Pressure roll (heat roll): The surface of a roll comprising a steel core was coated with a silicone rubber (HA30) to a thickness of 2 mm to prepare a pressure roll.

Receiving roll: The surface of a roll comprising a steel core was coated with a silicone rubber (HA80) to a thickness of 5 mm to prepare a receiving roll.

Surface temperature of pressure roll: 100° C.; linear pressure: 10 kN/m; passing velocity of laminated sheet: 10 mm/sec Example 3

A recorded material with protective layer was prepared in the same manner as in Example 1 except that the laminated sheet was subjected to press-bonding in the following manner (press-bonding condition 3).

(Press-bonding Condition 3)

Pressure roll (heat roll): The surface of a roll comprising a steel core was coated with a silicone rubber (HA40) to a thickness of 0.5 mm to prepare a pressure roll.

Receiving roll: The surface of a roll comprising a steel core was coated with a silicone rubber (HA80) to a thickness of 5 mm to prepare a receiving roll.

Surface temperature of pressure roll: 100° C.; linear pressure: 10 kN/m; passing velocity of laminated sheet: 10 mm/sec Comparative Example 1

A recorded material with protective layer was prepared in the same manner as in Example 1 except that the laminated sheet was subjected to press-bonding in the following manner (press-bonding condition 4).

(Press-bonding Condition 4)

Pressure roll (heat roll): The surface of a roll comprising a steel core was coated with a silicone rubber (HA80) to a thickness of 0.5 mm to prepare a pressure roll.

Receiving roll: The surface of a roll comprising a steel core was coated with a silicone rubber (HA80) to a thickness of 5 mm to prepare a receiving roll.

Surface temperature of pressure roll: 100° C.; linear pressure: 10 kN/m; passing velocity of laminated sheet: 10 mm/sec Comparative Example 2

A recorded material with protective layer was prepared in the same manner as in Example 1 except that the laminated sheet was subjected to press-bonding in the following manner (press-bonding condition 5).

(Press-bonding Condition 5)

Pressure roll (heat roll): The surface of a roll comprising a steel core was coated with a silicone rubber (HA60) to a thickness of 0.5 mm to prepare a pressure roll.

Receiving roll: The surface of a roll comprising a steel core was coated with a silicone rubber (HA80) to a thickness of 5 mm to prepare a receiving roll.

Surface temperature of pressure roll: 100° C.; linear pressure: 10 kN/m; passing velocity of laminated sheet: 10 mm/sec Evaluation of Properties The various recorded materials with protective layer thus prepared were each evaluated for the degree of entrance of bubbles, change of gloss and adhesion of protective layer in the following manner. The results are set forth in Table 1 below.

<Entrance of Bubbles>

Figure 4:
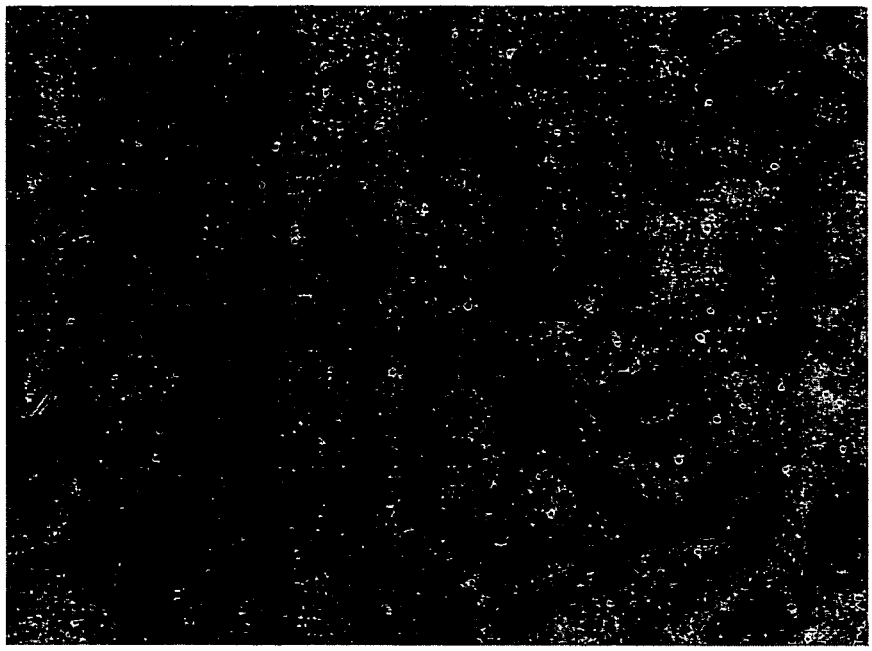
FIG. 4 is an optical microphotograph (60× magnification) of the surface of the protective layer of a recorded material with protective layer of Example 1.
Figure 5:
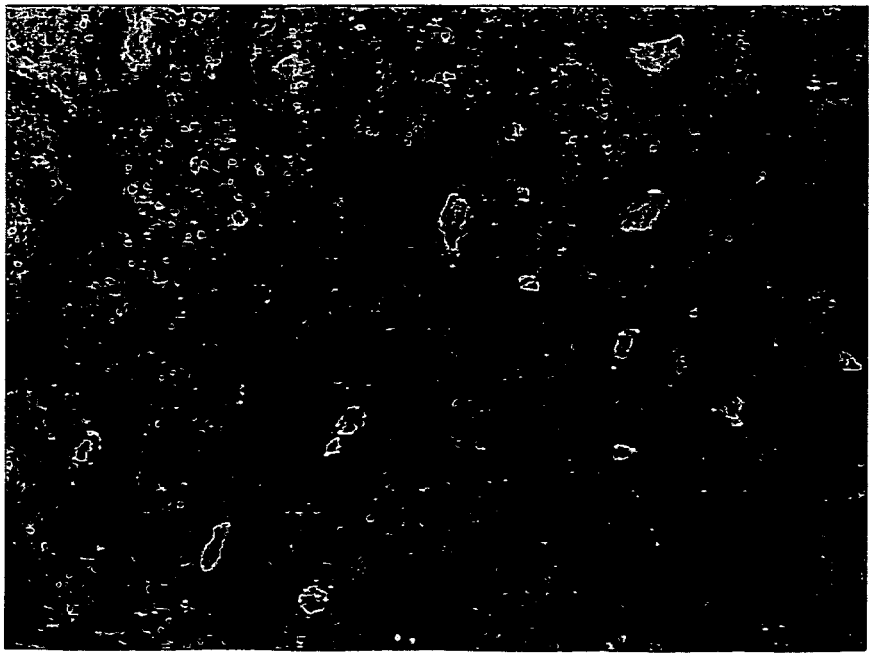
FIG. 5 is an optical microphotograph (60× magnification) of the surface of the protective layer of a recorded material with protective layer of Comparative Example 1.
Figure 6:
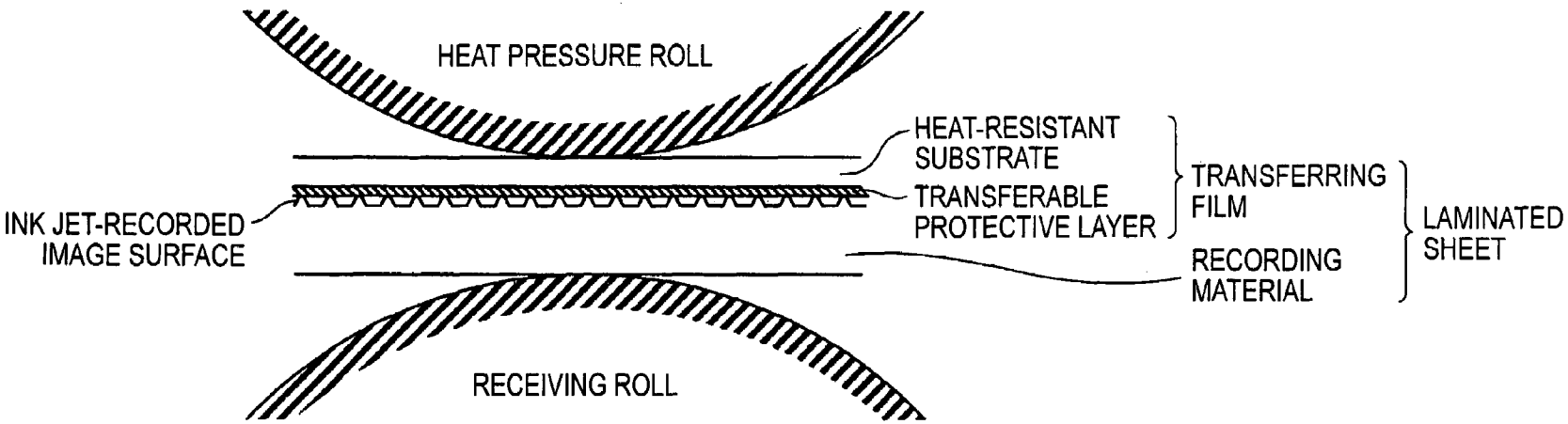
FIG. 6 is a diagram typically illustrating how heat transfer is carried out by a related art transferring unit.

The surface of the protective layer of the various recorded matters with protective layer were each observed at a magnifying power of 60 under an optical microscope. Those showing little or no entrance of bubbles in the gap between the protective layer and the image surface were ranked A. Those showing some but practically acceptable presence of bubbles were ranked B. Those showing much bubbles were ranked C (impracticable). For reference, FIG. 4 shows an optical microphotograph (60× magnification) of Example 1 and FIG. 5 shows an optical microphotograph (60× magnification) of Comparative Example 1. Example 1 (FIG. 4)

shows little or no bubbles while Comparative Example 1 (FIG. 5) shows much bubbles (white portions shown). It is thus made obvious that Example 1 has little or no bubbles present in the gap between the protective layer and the image surface.

<Change of Gloss>

Using a Type PC-1 glossmeter (produced by Nippon Denshoku Industries Co., Ltd.), the surface of the protective layer of the various recorded materials with protective layer were each measured for 60° gloss. The difference of this value from that of a blank separately prepared (aforementioned recorded material on which the protective layer is not yet formed) was then determined (60° gloss of recorded material with protective layer—60° gloss of blank) . The greater this difference is, the more is the leveling of the finely roughened surface of the recording sheet, i.e., the more is impaired the inherent texture of recorded material. It is obvious that Examples 1 to 3 show a relatively small difference in gloss from blank and thus maintain the inherent texture of recorded material while Comparative Examples 1 and 2 have a great difference in gloss from blank and hence raised uncomfortable glittering that impairs the texture of recorded material.

<Adhesion of Protective Layer>

An adhesive tape was stuck to the surface of the protective layer of the various recorded materials with protective layer. A load of 500 g/cm$^2$ was then placed on the protective layer so that the adhesive tape was firmly fixed to the surface of the protective layer. The adhesive tape was then rapidly peeled off the protective layer. Those showing no peeling of protective layer and hence no change of surface of protective layer were ranked A (good adhesion). Those showing peeling of protective layer to impracticability were ranked B. It is thought that the adhesion of the protective layer is related to the aforementioned degree of entrance of bubbles and the greater the number of bubbles present in the gap between the image surface and the protective layer is, the lower is the adhesion of protective layer.

TABLE 1

| | Elastic material layer of pressure roll | | Entrance | Change of gloss (leveling of finely | Adhesion of |
|---|---|---|---|---|---|
| | Hardness (degree) | Thickness (mm) | of bubbles | roughened surface) | protective layer |
| Example 1 | HA30 | 0.5 | A | +10% | A |
| Example 2 | HA30 | 2.0 | B | +15% | A |
| Example 3 | HA40 | 0.5 | B | +20% | A |
| Comparative Example 1 | HA80 | 0.5 | C | +40% | B |
| Comparative Example 2 | HA60 | 0.5 | C | +35% | B |

A recorded material with protective layer was prepared in the same manner as mentioned above except that as the recording sheet having a finely roughened surface there was used "PM/MC photographic paper <semi-gloss>" similarly comprising a polyolefin resin-coated paper as a base paper (produced by SEIKO EPSON CORPORATION; 75° mirror surface gloss and SRa value of polyolefin resin-coated paper are 12% and 2.0, respectively, according to JIS-P8142) instead of "Premium Luster Photo Paper". The recorded material with protective layer thus prepared was then evaluated for the degree of entrance of bubbles, change of gloss and adhesion of the protective layer. The results of evaluation were similar to those mentioned above. Even when a recording sheet free of finely roughened surface such as "PM photographic paper <gloss>" (produced by SEIKO EPSON CO., LTD.) was used, a protective layer was formed without any problems in the same manner as mentioned above.

The invention claimed is:

1. A transferring unit comprising:

(a) feed means for superimposing a transferring film atop a recording material to form a laminated sheet with a transferable protective layer of the transferring film atop a finely roughened surface of the recording material, the finely roughened surface comprising a plurality of raised portions having a height of from 5 to 20 μm and a pitch of from 50 to 500 μm, and the transferring film comprising a transferable protective layer provided on a heat-resistant substrate, said substrate comprising a polyethylene terephthalatic film:

(b) press-bonding means for heating and pressing the laminated sheet to cause the transferable protective layer to bond to the finely roughened surface of the recording material, said press-bonding means comprising a receiving member and transferring pressure roll means, including a transferring pressure roll, for pressing against the transferring film while the laminated sheet is being heated, said receiving member and transferring pressure roll being disposed adjacent each other with a gap therebetween, said feed means feeding the laminated sheet through the gap between the transferring pressure roll and the receiving member, said transferring pressure roll comprising a cylindrical roll main body and an elastic material layer which covers a surface of the roll main body, said elastic material layer comprising an elastic material with a hardness of less than HA40 as measured by a measuring method defined in JIS-K6253; and (c) peeling means for peeling the heat-resistant substrate off the laminated sheet heated and pressed by the press-bonding means; said feed means feeding the laminated sheet from the press-bonding means to the peeling means.

2. The transferring unit as defined in claim 1, wherein the thickness of the heat-resistant substrate is from 4 to 20 μm.

3. The transferring unit as defined in claim 1, wherein the thickness of the transferable protective layer is from 2 to 20 μm.

4. The transferring unit as defined in claim 1, wherein the transferable protective layer comprises a compound selected from the group consisting of acrylic copolymer, acryl-styrene copolymer, vinyl acetate resin, vinyl acetate copolymer, vinyl chloride-vinyl acetate copolymer, vinyl chloride-acryl copolymer, vinyl acetate-acryl copolymer and acryl-silicone copolymer.

5. An ink jet recording apparatus comprising:

(a) the transferring unit of claim 1; and (b) ink jet recording means for ejecting an ink onto the finely roughened recording surface of the recording material, said feed means feeding the recording material past the ink jet recording means prior to alignment of the recording material with the transferring film.

6. The transferring unit as defined in claim 1, wherein the thickness of the elastic material layer is from 0.2 to 5 mm.

7. A recording method comprising the steps of:

(a) providing a recording material having a finely roughened recording surface comprising a plurality of raised portions having a height of from 5 to 20 μm and a pitch of from 50 to 500 μm;

(b) providing a transferring film having a transferable protective layer and a heat-resistant substrate, said heat-resistant substrate comprising a polyethylene terephthalate film;

(c) forming an ink image on the recording surface by ejecting an ink onto the recording surface;

(d) superimposing the transferring film atop the recording material with the transferable protective layer of the transferring film atop the ink image on the recording surface of the recording material; and (e) bonding the transferable protective layer to the recording surface by pressing the transferable protective layer against the recording surface with a transferring pressure roll while heating whereby to form a protective layer on the ink image; the transferring pressure roll comprising a cylindrical roll main body and an elastic material layer which covers a surface of the roll main body and contacts the transferring film during the pressing, the elastic material layer comprising an elastic material having a hardness of less than HA40 as measured by a measuring method defined in JIS-K6253.

8. The recording method as defined in claim 7, further comprising the step of:

(f) peeling the heat resistant substrate from the transferring film.

9. The recording method as defined in claim 7, wherein the elastic material is selected from the group consisting of silicone rubber, natural rubber, synthetic natural rubber, styrene rubber, butadiene rubber, chloroprene rubber, butyl rubber, nitrile rubber, ethylene propylene rubber and fluororubber.

10. The recording method as defined in claim 7, wherein the thickness of the elastic material layer is from 0.2 to 5 mm.

11. The recording method as defined in claim 7, wherein a thickness of the heat-resistant substrate is from 4 to 20 μm.

12. The recording method as defined in claim 7, wherein a thickness of the transferable protective layer is from 2 to 20 μm.

13. The recording method as defined in claim 7, wherein the transferable protective layer comprises a compound selected from the group consisting of acrylic copolymer, acryl-styrene copolymer, vinyl acetate resin, vinyl acetate copolymer, vinyl chloride-vinyl acetate copolymer, vinyl chloride-acryl copolymer, vinyl acetate-acryl copolymer and acryl-silicone copolymer.

14. The recording method as defined in claim 7, wherein a surface temperature of the elastic material layer is from about 90° C. to 110° C.

15. The recording method as defined in claim 7, wherein a linear pressure of the elastic material layer is from 5 to 10 kN/m.

* * * * *